US006920821B2

(12) United States Patent
Ariji

(10) Patent No.: US 6,920,821 B2
(45) Date of Patent: Jul. 26, 2005

(54) DEVICE AND METHOD FOR CONTROLLING STOP OF HYDRAULIC PRESS AND DEVICE AND METHOD FOR DETECTING TROUBLE OF SPEED SELECTOR VALVE

(75) Inventor: Nobuaki Ariji, Kanagawa (JP)

(73) Assignee: Amada Company, Limited, Kanagawa (JP)

( * ) Notice: Subject to any disclaimer, the term of this patent is extended or adjusted under 35 U.S.C. 154(b) by 67 days.

(21) Appl. No.: 10/204,452

(22) PCT Filed: Mar. 2, 2001

(86) PCT No.: PCT/JP01/01625

§ 371 (c)(1),
(2), (4) Date: Dec. 4, 2002

(87) PCT Pub. No.: WO01/66340

PCT Pub. Date: Sep. 13, 2001

(65) Prior Publication Data

US 2003/0159599 A1 Aug. 28, 2003

(30) Foreign Application Priority Data

Mar. 6, 2000 (JP) ..... 2000-060852
Mar. 29, 2000 (JP) ..... 2000-091457

(51) Int. Cl.[7] ..... B30B 15/16; B30B 15/18

(52) U.S. Cl. ..... 100/35; 100/48; 100/99; 100/269.12; 100/269.14; 100/269.18; 60/413; 72/453.01; 83/639.1

(58) Field of Search ..... 100/35, 50, 270, 100/271, 273, 269.01, 269.14, 269.15, 269.16, 269.18, 269.19, 48, 99, 269.12; 72/453.18, 453.01, 453.06, 453.07, 453.09; 60/413, 414, 417, 418, 446, 448, 476, 451, 487; 700/206; 83/639.1, 639.5

(56) References Cited

U.S. PATENT DOCUMENTS 2,545,246 A 3/1951 Tucker et al. ..... 60/378
5,568,766 A * 10/1996 Otremba et al. ..... 100/35
6,240,758 B1 * 6/2001 Nagakura ..... 72/20.1

FOREIGN PATENT DOCUMENTS

DE 2503143 7/1976
GB 2016980 A * 9/1979 ..... B21J/9/10
JP 6-9799 2/1994
JP 10193200 7/1998
JP 2001-121299 5/2001

OTHER PUBLICATIONS

English Language Abstract of JP 2001–121299.

* cited by examiner

*Primary Examiner*—Allen Ostrager
*Assistant Examiner*—Jimmy T Nguyen
(74) *Attorney, Agent, or Firm*—Greenblum & Bernstein, P.L.C.

(57) ABSTRACT

A rod pressure holding instruction section controls a servo motor to rotate a two-way pump in a counter direction, and to supply hydraulic oil, with pressure which does not exceed pressure from a weight of a ram, to a two-way pump-side piping, increasing pressure. A difference between pressure in a rod-side cylinder chamber-side piping of a speed switching valve and pressure in a two-way pump-side piping of the speed switching valve is decreased, thereby decreasing an impact generated when switching the speed switching valve and stopping the ram at a predetermined position.

4 Claims, 5 Drawing Sheets

DEVICE AND METHOD FOR CONTROLLING STOP OF HYDRAULIC PRESS AND DEVICE AND METHOD FOR DETECTING TROUBLE OF SPEED SELECTOR VALVE

TECHNICAL FIELD

This invention relates to an oil hydraulic press stop control method employed if a ram is stopped at a constant position in an oil hydraulic press and a controller therefor, and an oil hydraulic press speed switching valve fault detection method and a detector therefor.

BACKGROUND ART

In a hydraulic circuit in a conventional oil hydraulic press, after an operation for rotating a servo motor to feed oil into a two-way pump is performed, the pressure of a cylinder rod-side cylinder chamber is in a state in which the pressure becomes constant by a counterbalance valve. On the other hand, the pressure of a two-way pump-side piping which connects a speed switching valve to the two-way pump is almost in an atmospheric pressure state.

Due to this, if the speed switching valve is switched, the pressure difference between before and after the switching of the valve causes an upper table to fall downward by several millimeters with quite a great impact. This phenomenon is not limited to the above-stated operation. If the upper table is stopped at an upper limit position and left as it is for a while, the pressure of the two-way pump-side piping is decreased by leakage since the two-way pump is also stopped while the upper table is stopped. If the speed switching valve is to be turned on in that state, the upper table disadvantageously, suddenly lowers.

The present invention has been made while paying attention to these conventional disadvantages, and the first object of the invention is to provide an oil hydraulic press stop control method and a controller therefor capable of eliminating an impact which is generated when a speed switching valve is switched while a ram is stopped.

In addition, the second object of the present invention has been made while paying attention to these disadvantages of the conventional art and is to provide a speed switching valve fault detection method and a detector therefor for a hydraulic press capable of detecting the fault of a speed switching valve and ensuring operation safety.

DISCLOSURE OF THE INVENTION

To attain the above-stated objects, a hydraulic press stop control method of the invention according to a first aspect includes the following steps of: supplying hydraulic oil to a head-side cylinder chamber or a rod-side cylinder chamber of an oil hydraulic cylinder by forward and counter rotation of a two-way pump driven by a servo motor, to thereby lower or raise a ram; supplying the hydraulic oil with pressure, which does not exceed pressure applied by an own weight of the ram, by the counter rotation of the two-way pump, to a piping on the two-way pump side: decreasing a pressure difference of the hydraulic oil between a the rod-side cylinder chamber-side piping of a speed switching valve provided halfway along a piping connecting the rod-side cylinder chamber of the hydraulic cylinder and the two-way pump and a two-way pump side piping of the speed switching valve: stopping the ram at a predetermined position: and further lowering or raising the ram, and pressing a workpiece by cooperation between a punch and a die attached to the ram.

With the above-stated configuration, if the ram is stopped at a predetermined position in pressing a workpiece by the cooperation between the punch and the die attached to the ram, the servo motor is controlled to rotate the two-way pump in a counter direction and the hydraulic oil with pressure, which does not exceed the pressure applied by the own weight of the ram, is supplied to the two-way pump-side piping to increase the pressure so as to decrease the difference between the pressure of the rod-side cylinder chamber-side piping of the speed switching valve provided halfway along the piping connecting the rod-side cylinder chamber of the hydraulic cylinder to the two-way pump and the pressure of the two-way pump side piping of the speed switching valve to thereby reduce an impact generated when switching the speed switching valve.

Therefore, by controlling the servo motor to rotate the two-way pump in the counter direction and supplying the hydraulic oil, which does not exceed the pressure applied by the own weight of the ram, to the two-way pump-side piping of the speed switching valve provided halfway along the piping connecting the rod-side cylinder chamber of the hydraulic cylinder to the two-way pump to increase the pressure, the difference between the pressure of the rod-side cylinder chamber of the speed switching valve and the pressure in the two-way pump-side piping thereof is decreased, making it possible to reduce an impact generated when switching the speed switching valve.

An oil hydraulic press stop control method of the invention according to a second aspect dependent on the first aspect, is characterized in that in the stop control method, the pressure of the hydraulic oil supplied to the two-way pump side piping is indicated by a parameter.

Therefore, a value for increasing the pressure of the two-way pump-side piping is input and indicated by a parameter, so that it is possible to input a desired value.

An oil hydraulic press stop controller of the invention according to a third aspect, is a controller for stopping a ram at a predetermined position if supplying hydraulic oil to a head-side cylinder chamber or a rod-side cylinder chamber of an oil hydraulic cylinder by forward and counter rotation of a two-way pump driven by a servo motor to thereby lower or raise a ram, and pressing a workpiece by cooperation between a punch and a die attached to the ram, the controller comprising: oil pressure detection means for detecting pressure of the hydraulic oil in a the two-way pump-side piping of a speed switching valve provided halfway along a piping between the rod-side cylinder chamber of the oil hydraulic cylinder and the two-way pump; and a rod pressure holding instruction section issuing a counter rotation instruction to the servo motor to supply the hydraulic oil with pressure, which does not exceed pressure applied by an own weight of the ram, to the two-way pump side piping so as to decrease a pressure difference of the hydraulic oil between the rod-side cylinder chamber-side piping-and the two-way pump-side piping of the speed switching valve.

Therefore, if the ram in stopped at a predetermined position in pressing a workpiece by the cooperation between the punch and the die attached to the ram, the rod pressure holding instruction section controls the servo motor to rotate the two-way pump in a counter direction and the hydraulic oil with pressure, which does not exceed the pressure applied by the own weight of the ram, is supplied to the two-way pump-side piping to thereby increase the pressure so as to decrease the difference between the pressure of the rod-side cylinder chamber-side piping of the speed switching valve provided halfway along the piping connecting the rod-side cylinder chamber of the hydraulic cylinder to the two-way pump and the pressure of the two-way pump side piping of the speed switching valve to thereby reduce an impact generated when switching the speed switching valve. The pressure of the two-way pump-side piping at this moment is detected and fed back by the oil pressure detection means.

In other words, the rod pressure holding instruction section controls the servo motor to rotate the two-way pump in the counter direction and the hydraulic oil, which does not exceed the pressure applied by the own weight of the ram, is supplied to the two-way pump-side piping of the speed switching valve provided halfway along the piping connecting the rod-side cylinder chamber of the hydraulic cylinder to the two-way pump to increase the pressure, whereby the difference between the pressure of the rod-side cylinder chamber of the speed switching valve and the pressure in the two-way pump-side piping thereof is decreased, making it possible to reduce an impact generated when switching the speed switching valve. The internal pressure of the two-way pump-side piping is detected and fed back by the oil pressure detection means.

An oil hydraulic press stop controller of the invention according to a fourth aspect dependent on the third aspect, further comprises: input means for indicating the pressure of the hydraulic oil supplied to the two-way pump-side piping by a parameter.

Therefore, a value for increasing the pressure of the two-way pump-side piping is input and indicated by a parameter, so that it is possible to input a desired value.

An oil hydraulic press speed switching valve fault detection method of the invention according to a fifth aspect, is a method for detecting a fault of a speed switching valve of a hydraulic press switching an elevation speed of a hydraulic cylinder driven by a pump driven by a servo motor using the speed switching valve to thereby vertically move a ram, and performing pressing by cooperation between a punch and a die attached to a lower end of the ram, the method comprising the following steps of: on/off switching the speed switching valve while rotating the servo motor at a constant number of revolutions, and detecting an actual speed of the ram; and determining that the speed switching valve is abnormal if the actual speed of the ram has no change to correspond to on/off switching of the speed switching valve.

Therefore, according to the hydraulic press speed switching valve fault detection method according to the above-stated invention, the speed of the ram is switched by the speed switching valve if the ram is lowered by the hydraulic cylinder and pressed by the cooperation between the punch and the die attached to the lower end of the ram. At this moment, the number of revolutions of the servo motor is set constant, the pump for driving the hydraulic cylinder is driven, an instruction to on/off switch the speed switching valve is issued, it is determined whether or not the actual speed of the ram changes in response to this instruction, and it is determined that the speed switching valve is abnormal if the actual speed of the ram does not change in response to the instruction. It is, therefore, possible to facilitate detecting the fault of the speed switching valve and to ensure operation safety.

In an oil hydraulic press speed switching valve fault detection method of the invention according to a sixth aspect dependent on the fifth aspect, if the actual speed of the ram does not exceed a predetermined speed, which is a threshold value, to correspond to an instruction to turn on and off the speed switching valve, it is determined that the speed switching valve is abnormal.

Therefore, according to the hydraulic press speed switching valve fault detection method according to the above-stated invention, the number of revolutions of the servo motor is set constant to drive the pump for driving the hydraulic cylinder, and the actual speed of the ram is compared with the predetermined speed which is a threshold value. If the actual speed of the ram does not change to exceed the predetermined speed in response to an instruction to on/off switch the speed switching valve, it is possible to determine that the speed switching valve is abnormal.

An oil hydraulic press speed switching valve fault detection method of the invention according to a seventh aspect dependent on the fifth or sixth aspect is characterized in that, in the fault detection method, if it cannot be determined that a pattern of a change in the actual speed of the ram corresponds to a pattern of the instruction to turn on and off the speed switching valve, it is determined that the speed switching valve is abnormal.

Therefore, if the number of revolutions of the servo motor is set constant to drive the pump for driving the hydraulic cylinder and the pattern of a change in the actual speed of the ram does not correspond to an instruction pattern for on/off switching the speed switching valve, it is possible determine that the speed switching valve is abnormal.

An oil hydraulic press speed switching valve fault detection method of the invention according to an eighth aspect, is a method for detecting a fault of a speed switching valve of a hydraulic press switching an elevation speed of a hydraulic cylinder driven by a pump driven by a servo motor using the speed switching valve to thereby vertically move a ram, and performing pressing by cooperation between a punch and a die attached to a lower end of the ram, the method comprising the following steps of: on/off switching the speed switching valve while moving the ram at a predetermined speed, and detecting an actual number of revolutions of the servo motor; and determining that the speed switching valve is abnormal if the actual number of revolutions of the servo motor has no change to correspond to on/off switching of the speed switching valve.

Therefore, according to the hydraulic press speed switching valve fault detection method according to the above-stated invention, the speed of the ram is switched by the speed switching valve if the ram is lowered by the hydraulic cylinder and pressed by the cooperation between the punch and the die attached to the lower end of the ram. At this moment, the ram is moved at a constant speed, an instruction to on/off switch the speed switching valve is issued in this state, and it is determined whether or not the number of revolutions of the servo motor for the two-way pump driving the hydraulic cylinder changes in response to this instruction. It is determined that the speed switching valve is abnormal if the number of revolutions of the servo motor for the two-way pump driving the hydraulic cylinder changes in response to this instruction. It is, therefore, possible to facilitate detecting the fault of the speed switching valve and to ensure operation safety.

An oil hydraulic press speed switching valve fault detection method of the invention according to a ninth aspect dependent of the eighth aspect is characterized in that, in the fault detection method, if the actual number of revolutions of the servo motor does not exceed a predetermined number of revolutions, which is a threshold value, to correspond to an instruction to turn on and off the speed switching valve, it is determined that the speed switching valve is abnormal.

Therefore, if the actual number of revolutions of the ram does not change to exceed a predetermined number of revolutions which is a threshold value in response to an instruction to on/off switch the speed switching valve while the ram is moved at a constant speed, it is possible to determine that the speed switching valve is abnormal.

An oil hydraulic press speed switching valve fault detection method of the invention according to a tenth aspect dependent on the eighth or ninth aspect is characterized in that in the fault detection method, if it cannot be determined that a pattern of a change in the actual speed of the ram corresponds to a pattern of the instruction to turn on and off the speed switching valve, it is determined that the speed switching valve is abnormal.

Therefore, if the pattern of a change in the actual speed of the ram does not correspond to an instruction pattern for on/off switching the speed switching valve while moving the ram at a constant speed, it is possible to determine that the speed switching valve is abnormal.

An oil hydraulic press speed switching valve fault detector of the invention according to an eleventh aspect, is a detector for detecting a fault of a speed switching valve of a hydraulic press switching an elevation speed of a hydraulic cylinder driven by a pump driven by a servo motor using the speed switching valve to thereby vertically move a ram, and performing pressing by cooperation between a punch and a die attached to a lower end of the ram, the controller comprising: ram speed detection means for detecting an actual speed of the ram when on/off switching the speed switching valve while rotating the servo motor at a constant number of revolutions; and speed switching valve abnormality determination section determining whether or not the actual speed of the ram has change to correspond to on/off switching of the speed switching valve and determining, if the actual speed of the ram has no change to correspond to on/off switching of the speed switching valve, that the speed switching valve is abnormal.

Therefore, according to the hydraulic press speed switching valve fault detector according to the above-stated invention, the speed of the ram is switched by the speed switching valve if the ram is lowered by the hydraulic cylinder and pressed by the cooperation between the punch and the die attached to the lower end of the ram. At this moment, the number of revolutions of the servo motor is set constant to drive the pump for driving the hydraulic cylinder, an instruction to on/off switch the speed switching valve is issued while the ram speed detection means is detecting the actual speed of the ram, it is determined, for example, whether or not the rising position of the actual speed of the ram changes in response to the rising position of the instruction to switch the speed switching valve, and the speed switching valve abnormality determination section determines that the speed switching valve is abnormal if the rising position of the actual speed of the ram does not change in response to that of the instruction. It is, therefore, possible to facilitate detecting the fault of the speed switching valve and to ensure operation safety.

An oil hydraulic press speed switching valve fault detector of the invention according to a twelfth aspect dependent on the eleventh aspect is characterized in that in the fault detector, if the actual speed of the ram does not exceed a predetermined speed, which is a threshold value, to correspond to an instruction to turn on and off the speed switching valve, the speed switching valve abnormality determination section determines that the speed switching valve is abnormal.

Therefore, according to the hydraulic press speed switching valve fault detector according to the above-stated invention, if the number of revolutions of the servo motor is set constant, the pump for driving the hydraulic cylinder is driven, and the actual speed of the ram detected by the ram speed detection means does not change to exceed the predetermined speed in response to an instruction to on/off switch the speed switching valve, the speed switching valve abnormality determination section can determine that the speed switching valve is abnormal.

An oil hydraulic press speed switching valve fault detector of the invention according to a thirteenth aspect dependent on the eleventh or twelfth aspect is characterized in that in the fault detector, if the speed switching valve abnormality determination section cannot determine that a pattern of a change in the actual speed of the ram corresponds to a pattern of the instruction to turn on and off the speed switching valve, the speed switching valve abnormality determination section determines that the speed switching valve is abnormal.

Therefore, if the number of revolutions of the servo motor is set constant to drive the pump for driving the hydraulic cylinder and the pattern of a change in the actual speed of the ram detected by the ram speed detection means does not correspond to an instruction pattern for on/off switching the speed switching valve, it is possible determine that the speed switching valve is abnormal.

An oil hydraulic press speed switching valve fault detector of the invention according to a fourteenth aspect is a detector for detecting a fault of a speed switching valve of a hydraulic press switching an elevation speed of a hydraulic cylinder driven by a pump driven by a servo motor using the speed switching valve to thereby vertically move a ram, and performing pressing by cooperation between a punch and a die attached to a lower end of the ram, the detector comprising: servo motor number of revolution detection means for detecting an actual number of revolutions of the servo motor when on/off switching the speed switching valve while moving the ram at a predetermined speed; and a speed switching valve abnormality determination section determining that the speed switching valve is abnormal if the actual number of revolutions of the servo motor has no change to correspond to on/off switching of the speed switching valve.

Therefore, according to the hydraulic press speed switching valve fault detector according to the above-stated invention, the speed of the ram is switched by the speed switching valve if the ram is lowered by the hydraulic cylinder and pressed by the cooperation between the punch and the die attached to the lower end of the ram. At this moment, the actual number of revolutions of the servo motor is detected by the servo motor number of revolution detection means while moving the ram at a constant speed, an instruction to on/off switch the speed switching valve is issued in this state, it is determined, for example, whether or not there is the rising position of the number of revolutions of the servo motor to correspond to the rising position of this speed switching valve switching instruction, and if the rising position of the number of revolutions of the servo motor does not correspond to the rising position of this speed switching valve switching instruction, the speed switching valve abnormality determination section determines that the speed switching valve is abnormal. It is, therefore, possible to facilitate detecting the fault of the speed switching valve and to ensure operation safety.

An oil hydraulic press speed switching valve fault detector of the invention according to a fifteenth aspect dependent on the fourteenth aspect is characterized in that in the fault detector, if the actual number of revolutions of the servo motor does not exceed a predetermined number of revolutions, which is a threshold value, to correspond to an instruction to turn on and off the speed switching valve, the speed switching valve abnormality determination section determines that the speed switching valve is abnormal.

Therefore, if the actual number of revolutions of the ram detected by the servo motor number of revolution detection means does not exceed the predetermined number of revolutions which is a threshold value in response to an instruction to on/off switch the speed switching valve while the ram is moved at a constant speed, the speed switching valve abnormality determination section can determine that the speed switching valve is abnormal.

An oil hydraulic press speed switching valve fault detector of the invention according to a sixteenth aspect dependent on the fourteenth or fifteenth aspect is characterized in that in the fault detector, if the speed switching valve abnormality determination section cannot determine that a pattern of a change in the actual speed of the ram corresponds to a pattern of the instruction to turn on and off the speed switching valve, the speed switching valve abnormality determination section determines that the speed switching valve is abnormal.

Therefore, if the pattern of the actual speed of the servo motor detected by the servo motor number of revolution detection means does not correspond to an instruction pattern for on/off switching the speed switching valve while moving the ram at a constant speed, the speed switching valve abnormality determination section can determine that the speed switching valve is abnormal.

BEST MODES FOR CARRYING OUT THE INVENTION

The first embodiment of this invention will be described hereinafter in detail based on the drawings.

Figure 1:
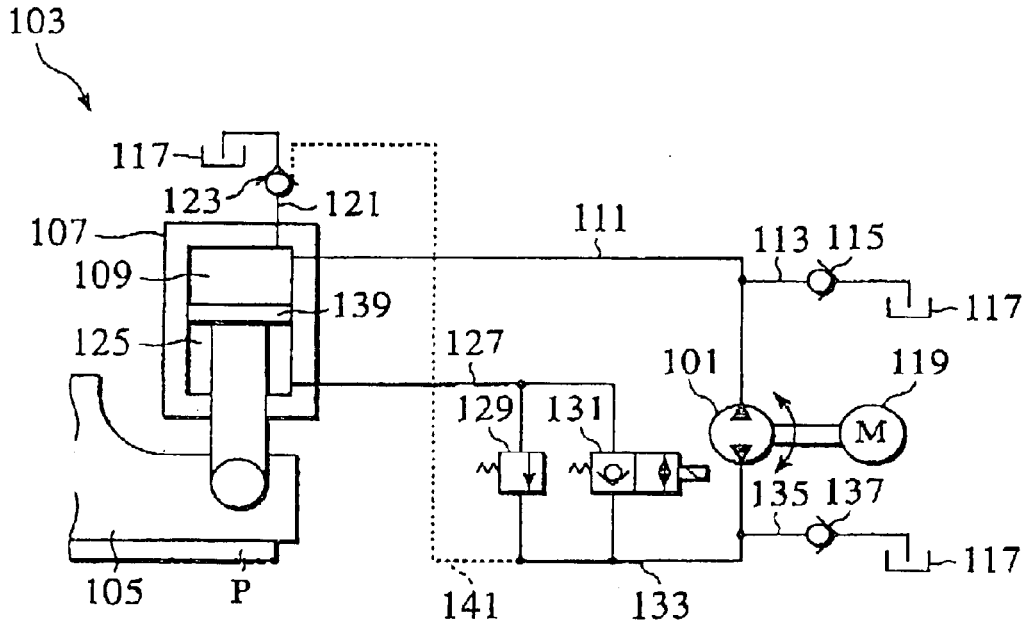
FIG. 1 is a circuit diagram showing an oil hydraulic press stop controller based on a first embodiment.

FIG. 1 shows a hydraulic circuit of an oil hydraulic press brake 103 which employs a two-way pump 101 based on the first embodiment. A cylinder head-side cylinder chamber 109 of a hydraulic cylinder 107, which vertically moves an upper table 105 which serves as a ram, is connected to one side of the two-way pump 101 which serves as a two-way pump through a piping 111. A piping 113 is connected halfway along the piping 111, and is connected to an oil tank 117 through a check valve 115. It is noted that the two-way pump 101 is actuated by a servo motor 119. In addition, the cylinder head-side cylinder chamber 109 is connected to the oil tank 117 through a pre-fill valve 123 by a piping 121.

On the other hand, a cylinder-side piping 127 is connected to a rod-side cylinder chamber 125 of the hydraulic cylinder 107, and a counterbalance valve 129 and a speed switching valve 131 are provided in parallel at the piping 127. The counterbalance valve 129 and the speed switching valve 131 are connected to the other side of the two-way pump 101 by a two-way pump-side piping 133.

Further, a piping 135 is connected halfway along the two-way pump-side piping 133, and this piping 135 is connected to the oil tank 117 through a check valve 137.

With the above-stated configuration, if the two-way pump 101 is rotated in a forward direction by the rotation of the servo motor 119 to thereby supply hydraulic oil from the oil tank 117 to the cylinder head-side cylinder chamber 109 through the check valve 137, the piping 135 and the piping 111, then a piston 139 lowers to thereby lower the upper table 105 and a punch P which is attached to the lower end of the upper table 105.

On the other hand, if the servo motor 119 rotates the two-way pump 101 in a counter direction, then the hydraulic oil is supplied from the oil tank 117 to the rod-side cylinder chamber 125 through the check valve 115, the piping 113 and further through the check valve of the speed switching valve 131, and the piston 139 rises to thereby raise the upper table 105 and the punch P.

If the pressure of the cylinder rod-side cylinder chamber 125 is higher than a predetermined value, then the pre-fill valve 123 opens in response to a pilot signal 141 and the hydraulic oil is directly fed to the oil tank 117 from the cylinder head-side cylinder chamber 109 while passing through the piping 121 and the pre-fill valve 123. The rotation of the servo motor 119 and that of the two-way pump 101 control the speed and position of the upper table 105.

In such a hydraulic circuit, however, after an operation for rotating the servo motor 119 and feeding the oil to the two-way pump 101 in the state shown in FIG. 1, the pressure of the cylinder rod-side cylinder chamber 125 is in a state in which the pressure is set constant by the counterbalance valve 129. On the other hand, the pressure of the two-way pump-side piping 133 which connects the speed switching valve 131 to the two-way pump 101 is almost in an atmospheric pressure state.

Due to this, if the speed switching valve 131 is switched to be turned on (moved left in FIG. 1) from the state shown in FIG. 1, the pressure difference between before and after the speed switching valve 131 causes the upper table 105 to fall downward by several millimeters with quite a great impact. This phenomenon is not limited to the above-stated operation. If the upper table 105 is stopped at an upper limit position and left as it is for a while, the pressure of the two-way pump-side piping 133 decreases by leakage since the two-way pump 101 is also stopped when the upper table 105 is stopped. If the speed switching valve 131 is to be turned on in that state, the upper table 105 disadvantageously, suddenly lowers.

Under these circumstances, the inventor of the present application modified this technique. An oil hydraulic press stop control method and a controller therefor based on the modified invention will be described hereinafter in detail as a second embodiment.

Figure 2:
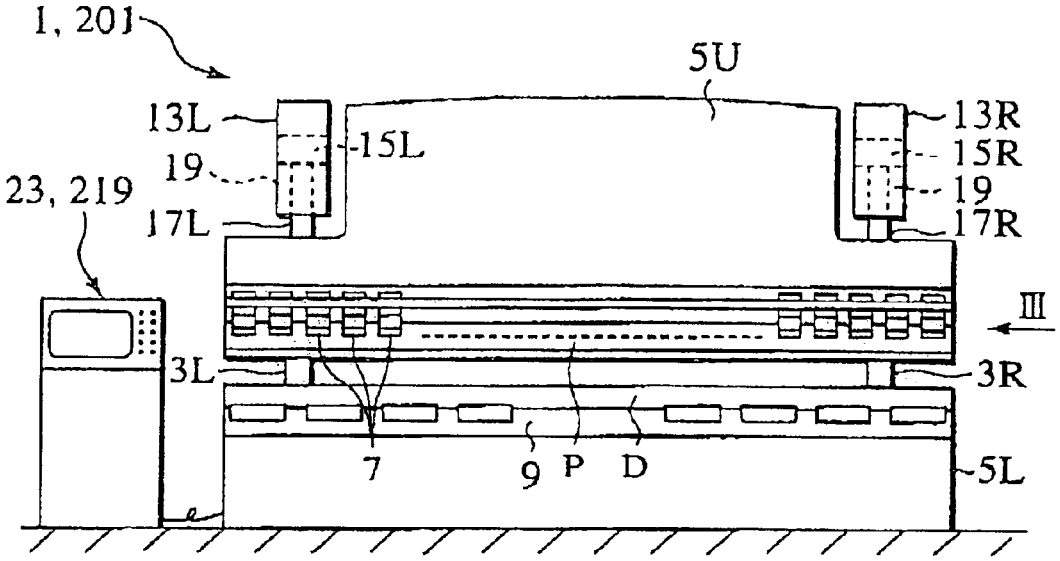
FIG. 2 is a front view showing a press brake to which the oil hydraulic press stop controller according to the present invention is applied.
Figure 3:
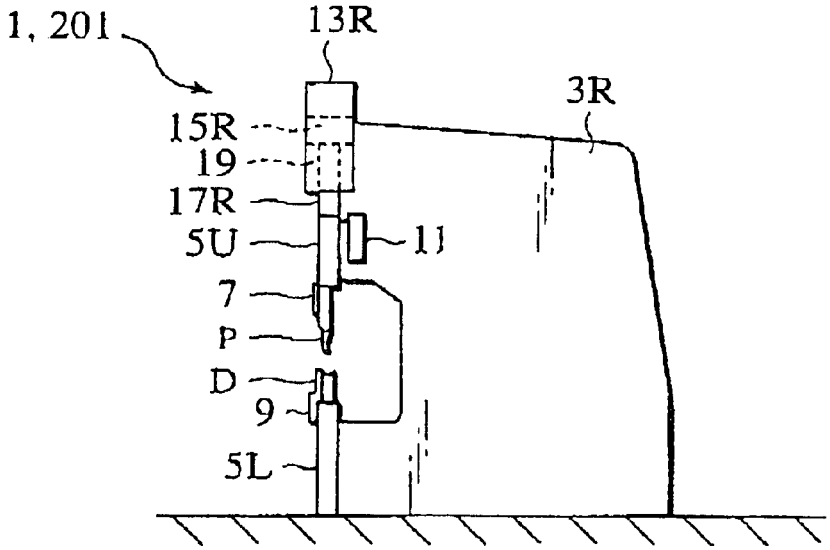
FIG. 3 is a side view of the press brake viewed from a direction III of FIG. 2.

FIGS. 2 and 3 show the entirety of one example of a press, e.g., an oil hydraulic press brake 1. This press brake 1 has side plates 3L and 3R which are built left and right, respectively, an upper table 5U, which serves as a ram, vertically movably provided on the upper front end surfaces of the side plates 3L and 3R, and a lower table 5L provided to be fixed to the lower front surfaces of the side plates 3L and 3R.

A punch P is provided on the lower end portion of the upper table 5U through intermediate plates 7 in an exchangeable manner. In addition, a die D is provided on the upper end portion of the lower table 5L through a die base 9 in an exchangeable manner.

It is noted that a linear scale 11 which serves as a ram position detection means (section) for measuring the height position of the upper table 5U is provided, so that the distance between the upper table 5U and the die D can be obtained using the heights of the intermediate plates 7 and the punch P which are known.

Hydraulic cylinders 13L and 13R are provided on the upper front surfaces of the left and right side plates 3L and 3R, respectively. The upper table 5U noted above is attached to piston rods 17L and 17R which are attached to pistons 15L and 15R of the hydraulic cylinders 13L and 13R, respectively.

Further, an oil pressure sensor 21 (see FIG. 4) which serves as an oil pressure detection means (section) for detecting the oil pressure of a piping 49 (see FIG. 4) on the side of a rod-side cylinder 19 of each of the hydraulic cylinders 13L and 13R, is attached. It is noted that a controller 23 which controls the hydraulic circuit and the like of the press brake 1 is provided adjacent the press brake 1.

Figure 4:
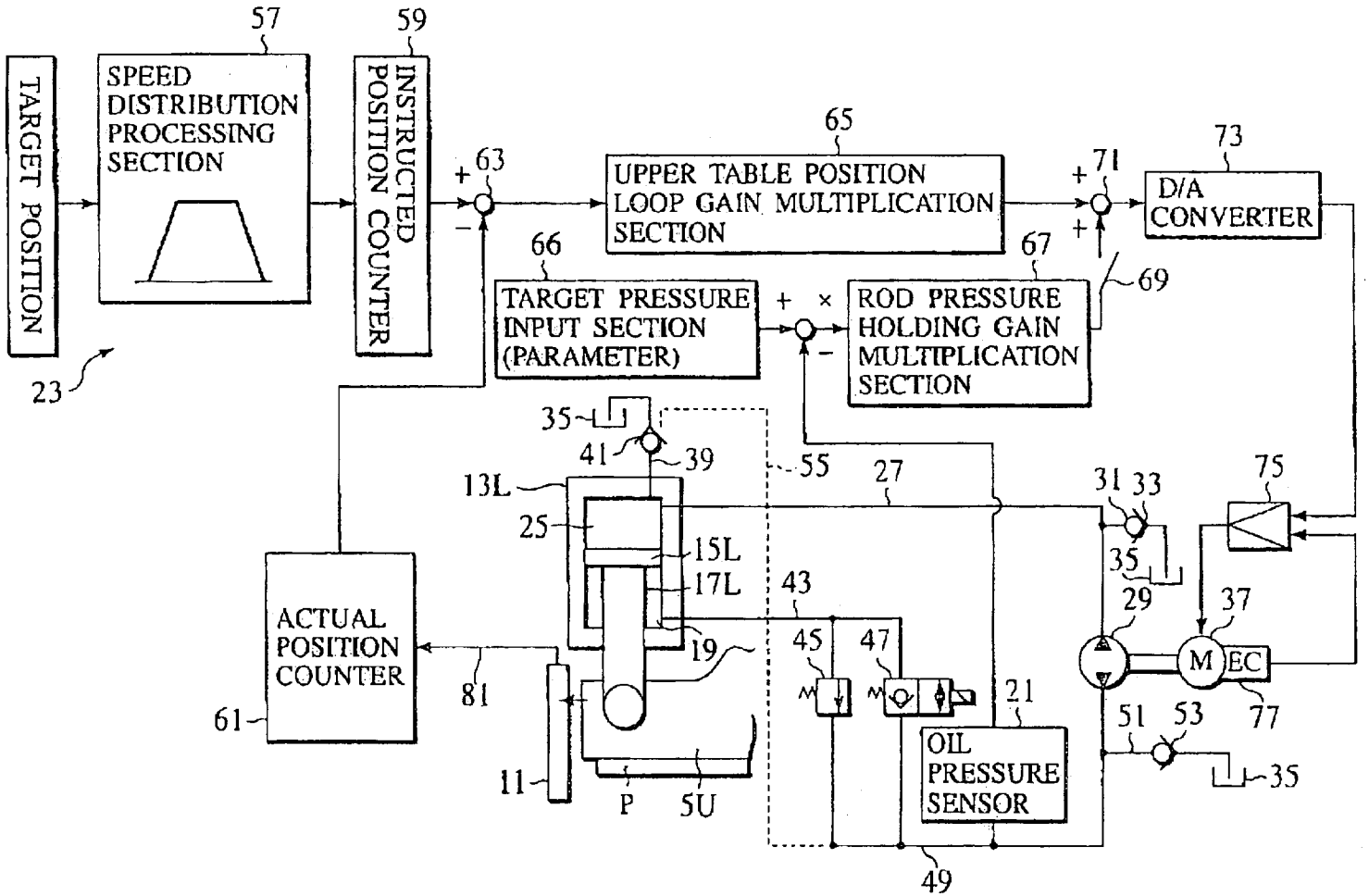
FIG. 4 is a circuit diagram of the oil hydraulic press stop controller according to the present invention and a block diagram of the controller.

Next, referring to FIG. 4, the hydraulic circuit which serves as the oil hydraulic press stop controller and the controller 23 according to this invention will be described. Since exactly the same hydraulic circuit is provided for each of the left and right hydraulic cylinders 13L and 13R, only the left-side hydraulic cylinder 13L will be described hereinafter.

A cylinder head-side cylinder chamber 25 of the hydraulic cylinder 13L which vertically moves the upper table 5U serving as a ram, is connected to one side of a two-way pump 29 serving as a two-way pump through a piping 27. A piping 31 is connected halfway along the piping 27, and is connected to an oil tank 35 through a check valve 33. It is noted that the two-way pump 29 is actuated by a servo motor 37. Further, the cylinder head-side cylinder chamber 25 is connected to the oil tank 35 through a pre-fill valve 41.

On the other hand, a rod-side cylinder-side piping 43 is connected to a rod-side cylinder chamber 19 of the hydraulic cylinder 13L, and a counterbalance valve 45 and a speed switching valve 47 are provided in parallel at the piping 43. The counterbalance valve 45 and the speed switching valve 47 are connected to the other side of the two-way pump 29 by a two-way pump-side piping 49.

Furthermore, a piping 51 is connected halfway along the two-way pump-side piping 49 and this piping 51 is connected to an oil tank 35 through a check valve 53. It is noted that the oil pressure sensor 21 which detects the internal pressure of the two-way pump-side piping 49 is provided at the two-way pump-side piping 49.

With the above-stated configuration, if the two-way pump 29 is rotated in a forward direction by the rotation of the servo motor 37 to thereby supply hydraulic oil from the oil tank 35 to the cylinder head-side cylinder chamber 25 through the check valve 53, the piping 51 and the piping 27, the piston 15L lowers to thereby lower the upper table 5U and the punch P.

On the other hand, if the servo motor 37 rotates the two-way pump 29 in a counter direction, then the hydraulic oil is supplied from the oil tank 35 to the rod-side cylinder chamber 19 through the check valve 33, the piping 31, the two-way pump-side piping 49, the check valve of the speed switching valve 47 and the cylinder-side piping 43 and the piston rod 17L rises to thereby raise the upper table 5U and the punch P.

It is noted that the upper and lower positions of the upper table 5U are detected by the linear scale 11. In addition, if the pressure of the rod-side cylinder chamber 19 is higher than a predetermined value, the pre-fill valve 41 (pilot-added check valve) opens in response to a pilot signal 55 and the hydraulic oil is fed from the cylinder head-side cylinder chamber 25 directly to the oil tank 35 through the pre-fill valve 41.

The controller 23 is provided with a ram speed distribution processing section 57 which issues a moving instruction to move the upper table 5U serving as a ram to a target position and which thereby gives a moving pattern to the upper table 5U. An instruction position counter 59 reads the instructed position of the upper table 5U from an instruction from this ram speed distribution processing section 57.

On the other hand, an actual position counter 61 reads and feeds back an actual position signal from the linear scale 11 which detects the positions of the upper table 5U as indicated by a line 81, and an adder 63 adds up this fed-back signal and the instructed position read by the instructed position counter 59. An upper position loop gain multiplication section 65 multiplies the value added by this adder 63 by a position loop gain.

Furthermore, since the pressure of the rod-side two-way pump-side piping 49 decreases by leakage with the passage of time, the pressure of the two-way pump-side piping 49 is increased to compensate for this decrease A target pressure therefor (e.g., 6 MPa equal to the rod-side cylinder-side pressure) is input as a parameter from a target pressure input means (section) 66 such as a keyboard, and a rod pressure holding section gain multiplication section 67 multiplies the difference between the target pressure and actual pressure which is detected by the hydraulic sensor 21 provided at the two-way pump-side piping 49 by a rod pressure holding gain.

If necessary, a switch 69 is turned on and off, an adder 71 adds up the multiplication result of multiplying the pressure difference by the rod pressure holding gain and that of multiplying the addition value by the upper table position loop gain as described above, this signal is D/A converted by a D/A converter 73 and transmitted to the servo motor 37 through a servo amplifier 75. It is noted that a rotary encoder 77 is attached to the servo motor 37 so that the number of revolutions of the servo motor 37 is fed back to the servo amplifier 75 to hold a predetermined number of revolutions.

As a result of the above, the servo motor 37 is controlled to rotate the two-way pump 29 in the counter direction and the pressure of the two-way pump-side piping 49 on the side of the rod-side cylinder chamber 19 of the hydraulic cylinder 13L is raised to a predetermined pressure. Therefore, even if the pressure of the piping 49 decreases by leakage, it is possible to keep the difference between the pressure of the piping 49 and that of the rod-side cylinder chamber-side piping 43 to be small or zero. Due to this, it is possible to prevent the upper table 5U from lowering with a jolt if the speed switching valve 47 is switched while the upper table 5U is stopped.

It is noted that this invention is not limited to the second embodiment of the invention stated above but can be carried out by the other embodiment. Namely, while the press brake 1 has been described as an example of a press in the embodiment of this invention, the invention can be applied to the other press in exactly the same manner.

Meanwhile, the technique of the first embodiment has a disadvantage in that if a fault such as "galling" takes place from the state of the speed switching valve 131 shown in FIG. 1 and the hydraulic brake does not operate as instructed, then the upper table 105 suddenly falls to entail danger.

The inventor of the present application, therefore, further modified this technique. A speed switching valve fault detection method and a detector for an oil hydraulic press based on the modified invention will be described hereinafter in detail as a third embodiment based on the drawings.

FIG. 2 shows the entirety of an example of a press, e.g., a hydraulic or an oil hydraulic press brake 201 as the third embodiment. This press brake 201 has side plates 3L and 3R which are built left and right, respectively, an upper table 5U, which serves as a ram, vertically movably provided on the upper front end surfaces of the side plates 3L and 3R, and a lower table 5L provided to be fixed to the lower front surfaces of the side plates 3L and 3R.

As shown in FIG. 2, a controller 219 which controls the hydraulic circuit and the like of the press brake 201 is provided adjacent the press brake 201.

Figure 5:
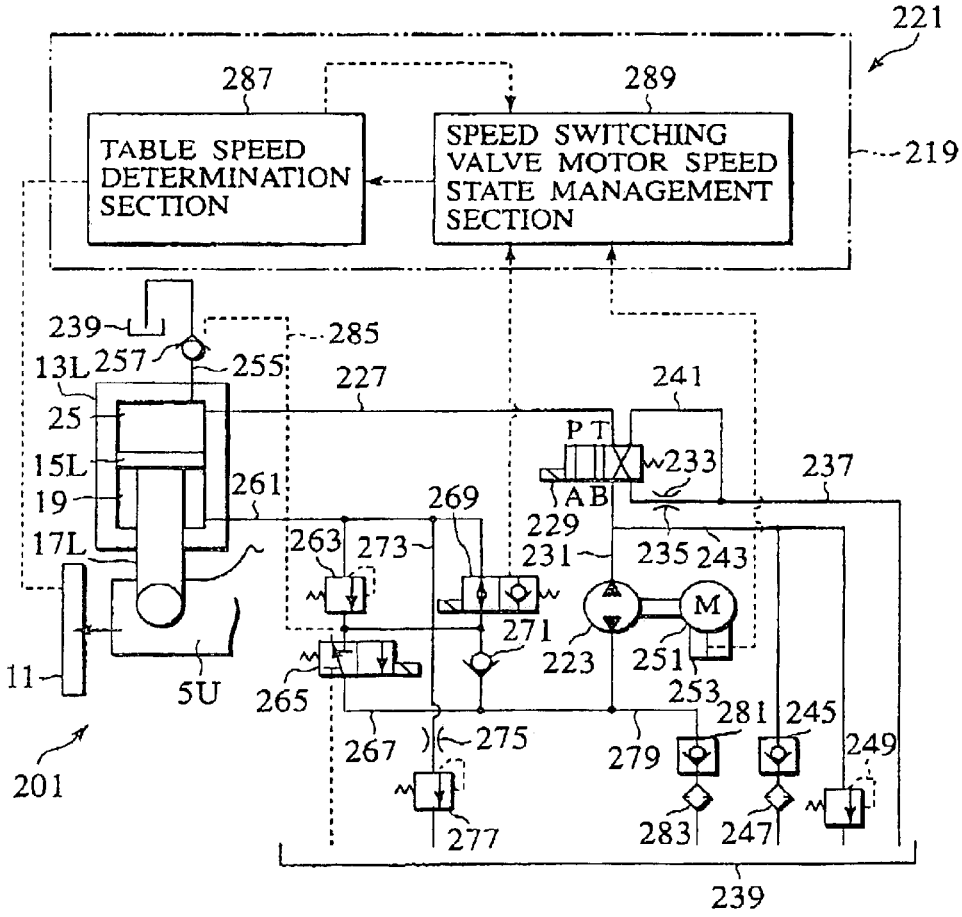
FIG. 5 is a circuit diagram and a block diagram showing an oil hydraulic press speed switching valve fault detector according to the present invention.

FIG. 5 shows the hydraulic press brake 201 which employs a two-way pump 223, as one example of the hydraulic press, and which is used as a speed switching valve fault detector 221 for the hydraulic press according to the present invention. Since the same hydraulic circuit is provided on each of the right and left of the press brake 201, description will now be given while taking the left-side of the press brake 201 as an example.

In this press brake 201, a piping 227 is connected to the head-side cylinder chamber 25 of the hydraulic cylinder 13L which vertically moves the upper table 5U serving as a ram, and a safety valve 229 is connected to this piping 227.

One of the pump-side ports of the safety valve 229 is connected to a two-way pump 223 through a piping 231, while the other pump-side port thereof is connected to an oil tank 239 through an orifice 235 and a piping 237. It is noted that the piping 237 is connected halfway to one of the cylinder-side ports of the safety valve 229 through a piping 241.

Further, a piping 243 is connected halfway along the piping 231, and is connected to the oil tank 239 through a check valve 245 and a filter 247 or a relief valve 249.

It is noted that the two-way pump 223 is actuated by a servo motor 251, and an encoder 253 which is one example of a servo motor number of revolution detection means (section) is attached to this servo motor 251. In addition, the head-side cylinder chamber 25 is connected to the oil tank 239 through a pre-fill valve 257 by a piping 255.

On the other hand, a piping 261 is connected to the rod-side cylinder chamber 19 of the hydraulic cylinder 13L, and a counterbalance valve 263 and a pilot signal switching valve 265 are connected to the piping 237. Further, the piping 261 is connected to a piping 267 through a speed switching valve 269 and a check valve 271. Further, the piping 267 is connected to the oil tank 239 through an orifice 275 and a relief valve 277 which are provided at the piping 267.

The piping 267 is connected to the other side of the two-way pump 223. In addition, a piping 279 is connected halfway along the piping 267, and this piping 279 is connected to the oil tank 239 through a check valve 281 and a filter 283.

With the above-stated configuration, if the safety valve 229 is set in a high state, the servo motor 251 rotates the two-way pump 223 in a forward direction and hydraulic oil is supplied from the oil tank 239 to the head-side cylinder chamber 25 through the filter 283, the check valve 271, the piping 279, the piping 231, the safety valve 229 and the piping 227, then the piston 15L lowers and the upper table 5U and the punch P attached to the lower end of the upper table 5U thereby lower.

On the other hand, if the servo motor 251 rotates the two-way pump 223 in a counter direction, then the hydraulic oil is supplied to the rod-side cylinder chamber 19 while passing the piping 267 through the filter 247, the check valve 245, the pipings 243 and 231, passing the piping 261 though the check valve 271 and the check valve of the speed switching valve 269 and the piston 15L rises to thereby raise the upper table 5U and the punch P.

If the pilot signal switching valve 265 is switched to thereby make the pressure of the piping 267 of the rod-side cylinder chamber 19 higher than a predetermined value, then the pre-fill valve 257 opens in response to a pilot signal 285 and the hydraulic oil is fed from the head-side cylinder chamber 25 directly to the oil tank 239 while passing the piping 255 and the pre-fill valve 257.

Further, the controller 219 which serves as the speed switching valve fault detector for the hydraulic press according to this invention is comprised of a table speed determination section 287 which is one example of a ram speed detection means (section) for determining the speed of the upper table 5U from a change in the position signal for the upper table 5U supplied from the linear scale 11, and a speed switching valve/motor speed state management section 289 which is one example of a speed switching valve abnormality determination section which determines whether the state of the speed switching valve 269 is normal or abnormal by comparing the table speed determined by this table speed determination section 287 with the state of the speed switching valve 269 or based on a signal from the encoder 253 which is one example of the servo motor number of revolution detection means (section) of the servo motor 251.

Next, an oil hydraulic press speed switching valve fault detection method according to this invention will be described with reference to FIG. 6 and FIG. 7.

Figure 6:
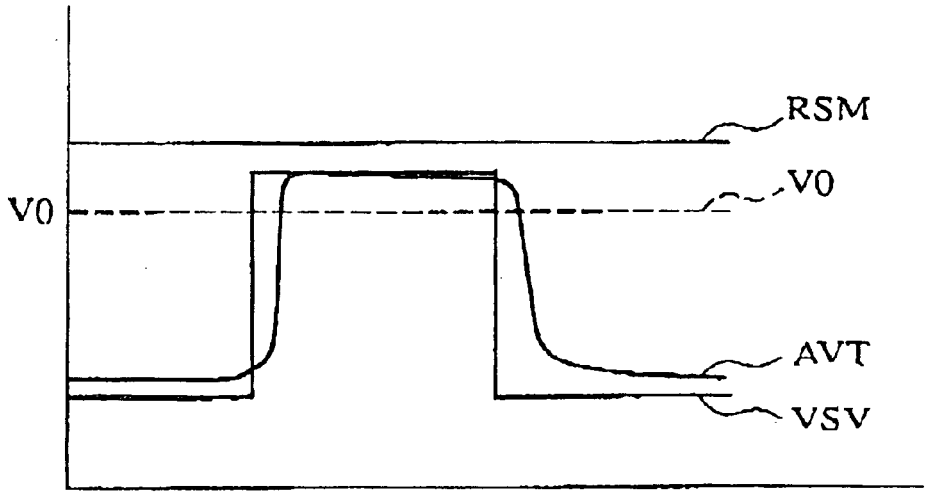
FIG. 6 is a time chart showing a normal upper table moving pattern if a speed switching valve is switched while the number of revolutions of a servo motor is kept constant.

First, FIG. 6 shows a method for detecting the fault of the speed switching valve 269 by operating the servo motor 251 at a constant number of revolutions RSM, turning on and off the speed switching valve 269 in this state, allowing the table speed determination section 287 to obtain the moving speed of the upper table 5U at this time based on the position signal for the upper table 5U from the linear scale 11, allowing the speed switching valve/motor speed state management section 289 to determine whether or not the moving speed of this upper table 5U is switched to a predetermined speed.

That is, during an origin return operation (a descent operation), the speed switching valve 69 is switched to off on off as indicated by VSV in the diagram while the servo motor 251 is operated at the constant number of revolutions RSM. It is checked that the actual speed AVT of the table 5U changes to a predetermined value according to the operation of the speed switching valve (indicated by a thin solid line in FIG. 6).

Further, as shown in FIG. 6, if a change in the actual moving speed AVT of the upper table 5U follows up the instruction VSV to the speed switching valve 269, the speed switching valve/motor speed state management section 289 determines that the speed switching valve 269 is normal. If the change in the actual moving speed AVT of the upper table 5U does not follow up the instruction VSV to the speed switching valve 269, the speed switching valve/motor speed state management section 259 determines that the speed switching valve 269 is abnormal.

In this case, whether or not the actual speed AVT of the upper table 5U follows up the operation of the speed switching valve can be determined by, for example, determining whether or not the actual speed AVT of the upper table 5U exceeds a rising position and a fixed threshold value V0. Alternatively, the pattern shape of the instruction to the speed switching valve 69 may be compared with that of the change in the speed of the upper table 5U so as to determine, for example, an actual pattern is deviated from the pattern of the instruction.

Figure 7:
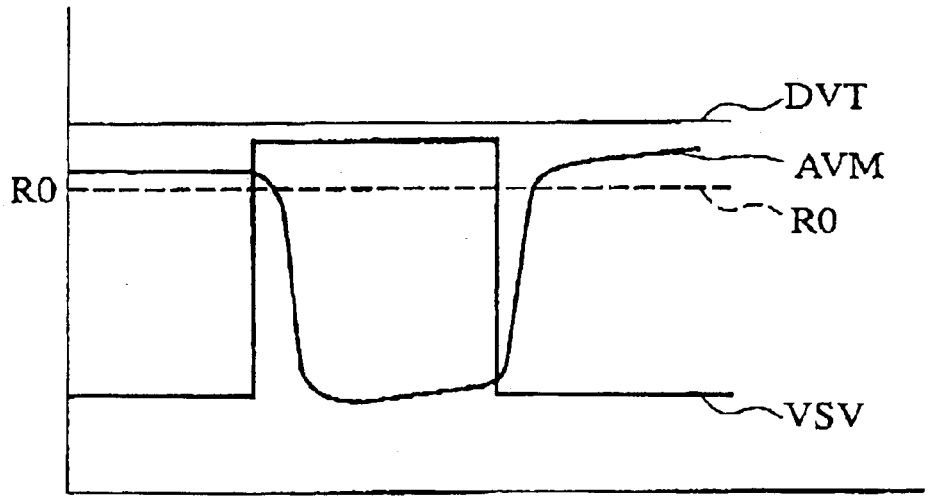
FIG. 7 is a time chart showing an abnormal upper table moving pattern if the speed switching valve is switched while the moving speed of the upper table is kept constant.

Further, FIG. 7 shows a method for detecting the fault of the speed switching valve 269 by operating the upper table 5U at a predetermined speed DVT, and confirming that the actual number of revolutions AVM of the servo motor 251 changes when turning the speed switching valve 269 on and off, from a signal applied from the encoder 253.

That is, during a descent operation, it is confirmed that the upper table starts moving in an off state and moves at a predetermined speed, the speed switching valve 269 is switched to be turned on and a change in the actual number of revolutions of the servo motor 251 at this time is monitored, whereby the operation of the speed switching valve 269 can be checked for each stroke.

If the actual number of revolutions of the servo motor 251 follows up the instruction to the speed switching valve 269, it is determined that the speed switching valve 269 is normal As shown in FIG. 7, if the actual number of revolutions of the servo motor 251 does not follow up the instruction to the speed switching valve 269, it is determined that the speed switching valve 269 is abnormal.

In this case, whether the actual number of revolutions of the servo motor 251 follows up the instruction to the speed switching valve can be determined by, for example, determining whether or not the actual number of revolutions of the servo motor 251 exceeds a rising position and a fixed threshold value R0. Alternatively, the pattern shape of the instruction to the speed switching valve 269 may be compared with that of the change in the number of revolutions of the servo motor 251 so as to determine, for example, that the actual pattern is deviated from the instruction pattern.

As a result of the above, it is possible to detect the fault of the speed switching valve 269 and to thereby ensure operation safety.

This invention is not limited to the above-stated embodiment but being carried out in other improved embodiments. Namely, while the press brake 201 as the hydraulic press has been described in the embodiment of the invention, the hydraulic press is not limited to the press brake. Further, the present invention is applicable to a case of employing a one-way pump and a directional switching valve for switching the elevation operation of the ram without employing the two-way pump.

What is claimed is:

1. A hydraulic press stop-control method, comprising:

supplying hydraulic oil to one of a head-side cylinder chamber of a hydraulic oil cylinder and a rod-side cylinder chamber of the hydraulic oil cylinder by forward and reverse rotation of a two-way pump driven by a servo motor, to thereby move a ram vertically;

pressurizing the hydraulic oil with a pressure, which does not exceed a pressure resulting from a weight of the ram, by the reverse rotation of the two-way pump;

decreasing a pressure difference of the hydraulic oil between a rod-side cylinder chamber-side piping on a rod-side cylinder chamber-side of a speed switching valve and a two-way pump-side piping on a two-way pump side of the speed switching valve, the speed switching valve being provided along a piping connecting the two-way pump and a rod-side cylinder chamber of the hydraulic cylinder;

stopping the ram at a predetermined position; and moving the ram vertically, and pressing a workpiece by cooperation between a punch and a die attached to the ram.

2. The hydraulic oil press stop-control method according to claim 1, wherein the pressure of the hydraulic oil supplied to the two-way pump-side piping is indicated by a parameter.

3. An hydraulic oil press stop-controller for stopping a ram at a predetermined position when hydraulic oil is supplied to one of a head-side cylinder chamber and a rod-side cylinder chamber of a hydraulic oil cylinder by forward and reverse rotation of a two-way pump driven by a servo motor, to move a ram vertically, the stop-controller comprising:

an oil pressure detector that detects pressure of hydraulic oil in a two-way pump-side piping on a two-way pump-side of a speed switching valve provided along a piping between the two-way pump and the rod-side cylinder chamber of the hydraulic oil cylinder; and a rod pressure holding instruction section that issues a reverse rotation instruction to the servo motor to supply the hydraulic oil with a pressure, which does not exceed a pressure applied by a weight of the ram, to the two-way pump-side piping so as to decrease a pressure difference of the hydraulic oil between a rod-side cylinder chamber-side piping and the two-way pump-side piping.

4. The hydraulic oil press stop-controller according to claim 3, further comprising:

an input section to indicate the pressure of the hydraulic oil supplied to the two-way pump-side piping by a parameter.

* * * * *